US005813309A

United States Patent [19]

Taka et al.

[11] Patent Number: 5,813,309

[45] Date of Patent: Sep. 29, 1998

[54] PRESSURE COMPENSATION VALVE UNIT AND PRESSURE OIL SUPPLY SYSTEM UTILIZING SAME

[75] Inventors: Keisuke Taka; Kazunori Ikei, both of Tochigi-ken, Japan

[73] Assignee: Komatsu Ltd., Japan

[21] Appl. No.: 704,568

[22] PCT Filed: Mar. 15, 1995

[86] PCT No.: PCT/JP95/00437

§ 371 Date: Sep. 10, 1996

§ 102(e) Date: Sep. 10, 1996

[87] PCT Pub. No.: WO95/25228

PCT Pub. Date: Sep. 21, 1995

[30] Foreign Application Priority Data

Mar. 15, 1994 [JP] Japan ..... 6-441503

[51] Int. Cl.[6] ..... F15B 11/08

[52] U.S. Cl. ..... 91/447; 91/448

[58] Field of Search ..... 91/444, 446, 447, 91/448; 60/426

[56] References Cited

U.S. PATENT DOCUMENTS 5,067,389 11/1991 Germain ..... 91/447 X 5,447,093 9/1995 Budzich ..... 91/448 X 5,533,334 7/1996 Takeuchi et al. ..... 91/446 X

FOREIGN PATENT DOCUMENTS 4-244604 9/1992 Japan .

5-42703 6/1993 Japan .

*Primary Examiner*—Hoang Nguyen

*Attorney, Agent, or Firm*—Rader, Fishman, & Grauer; Ronald P. Kananen

[57] ABSTRACT

A pressure compensation valve unit comprises a check valve which is pushed in an opening direction thereof by an inlet side pressure and in a closing direction thereof by an outlet side pressure and a pressure reducing valve actuating to establish communication between the inlet side and the outlet side and block the communication therebetween, pushed in the blocking up direction by a pressure in a pressure receiving chamber to push the check valve in the closing direction thereof, pushed in the communication direction with a highest pressure in a plurality of pressures by a pressure selective receiving means, and communicating the outlet side with the pressure chamber, and a pressure oil supply system is provided with the pressure compensation valve unit of the structure described above.

14 Claims, 13 Drawing Sheets

PRESSURE COMPENSATION VALVE UNIT AND PRESSURE OIL SUPPLY SYSTEM UTILIZING SAME

TECHNICAL FIELD

The present invention relates to a pressure compensation valve unit of a pressure oil supply system for supplying a discharge pressure oil from one hydraulic pump to a plurality of actuators and a pressure oil supply system utilizing the pressure compensation valve unit.

BACKGROUND ART

As a pressure oil supply system for supplying discharge pressure oil from one hydraulic pump to a plurality of actuators, there is known a system shown in, for example, Japanese Patent Laid-open Publication No. HEI 4-244604.

In such system, as shown in FIG. 1, a plurality of pressure compensation valve units 3 are connected in parallel to a discharge passage 2 of one hydraulic pump 1, and a plurality of actuators 5 are connected respectively to outlet sides of the respective pressure compensation valve units through a plurality of directional control valves 4 in a manner such that when the plurality of actuators 5 are simultaneously actuated, the respective pressure compensation valve units 3 are set in accordance with the highest load pressure to thereby to be able to supply the discharge pressure oil from one hydraulic pump 1 to the actuators 5 which are of different loads, respectively.

Each of the pressure compensation valve units 3 is provided with a check valve 6 and a pressure reducing valve 7. The check valve 6 is pushed in a valve opening direction by a inlet pressure introduced into a pressure chamber a and in a valve closing direction by an outlet pressure introduced into pressure chamber b, and the outlet side of the check valve 6 is communicated with a pump port 4*a* of the directional control valve 4. The pressure reducing valve 7 is pushed in a valve opening direction by a load pressure of a corresponding actuator 5 introduced into a pressure chamber c via a load pressure introducing passage 8 and is pushed in a valve closing direction by a spring force of a spring 9 having a weak spring force and an outlet pressure introduced into a pressure chamber d. The pressure reducing valve 7 is provided with a push rod 10 for pushing the check valve 6 in its closing direction, so that the communication between the inlet side and the outlet side thereof is established and blocked and the check valve 6 is pushed in its closing direction by the pressure difference between a load pressure of an actuator 5 acting on a pressure receiving portion c and a pressure acting on a pressure receiving portion d the communication between the inlet side and the outlet side thereof is established and blocked.

The outlet sides of the respective pressure reducing valves 7 are communicated with load pressure detection passages 11, respectively, which are communicated with a tank 13 through a throttle passage 12.

The hydraulic pump 1 has a variable capacity structure, and an angle of a swash plate 14 of the hydraulic pump 1 is changed by an adjusting cylinder 15 to which pump discharge pressure is supplied by the directional control valve 16 for a pump operation adjustment. The directional control valve 16 for pump operation adjustment is pushed to the discharge side by the spring force of a spring 17 and a load pressure in the load pressure detection passage 11 and is pushed to the communication side by the pump discharge pressure.

As mentioned above, when a plurality of actuators 5 are operated all at once, the pressure reducing valve 7 of the pressure compensation valve unit 3 connected to one actuator 5 having a large load (for example, an actuator 5, lefthand one as viewed in FIG. 1) is pushed rightward to establish communication between the inlet and outlet sides thereof, whereby the large load pressure acts on the pressure receiving portion d of the pressure reducing valve 7 of the pressure compensation valve unit 3 connected to another one actuator 5 having a small load (for example, an actuator 5, righthand one, as viewed in FIG. 1). At this time, since the load pressure acting on the pressure receiving portion c of the pressure reduction valve 7 is small, this pressure reduction valve 7 is pushed leftward to block the communication between the inlet and outlet sides thereof and the check valve 6 is also pushed in a valve closing direction to reduce the opening area thereof. Accordingly, a high pressure oil for compensating for the large load is supplied to the lefthand actuator 5 and a low pressure oil for compensating for the small load is supplied to the righthand actuator 5.

There is known a pressure compensation valve having a concrete structure of the above-mentioned pressure compensation valve unit 3, for example, as disclosed in Japanese Utility Model Laid-open Publication No. HEI 5-42703.

The concrete structure thereof is shown in FIG. 2, in which a spool bore 34, a check valve bore 35 and a pressure reducing valve bore 36 are formed to a valve body 20 of the directional control valve 4. A main spool 37 is inserted into the spool bore 34 for communicating the spool bore with an inlet port, a load pressure detection port, an actuator port, a tank port, etc. all opened thereto or for blocking the communication therebetween, thus constituting the directional control valve 4. Further, a spool 23 is inserted into the check valve bore 35 for communicating this bore with an inlet port 21 and an outlet port 22 opened thereto or for blocking the communication therebetween, thus constituting the check valve 6. Furthermore, a spool 26 is inserted into the pressure reducing valve bore 36 for communicating this bore with a first port 24 and a second port 25 opened thereto or for blocking the communication therebetween, a first pressure receiving chamber 27 and a second pressure receiving chamber 28 are formed on respective end sides of the bore 36, and the spool 26 is pushed leftward as viewed in FIG. 2 to abut against the spool 23 of the check valve 6, thus constituting the pressure reducing valve 7.

Further, it is to be noted that since only the load pressure of the corresponding actuator (called hereafter corresponding load pressure) acts on the pressure receiving portion c of the pressure reducing valve 7 of the pressure compensation valve unit 3 mentioned above, it is always necessary to locate one pressure compensation valve unit 3 to one actuator 5.

For example, with reference to FIG. 1, in a case where the output side of the lefthand pressure compensation valve unit 3 is connected, without disposing the righthand pressure compensation valve unit, to the pump port 4*a* of the righthand directional control valve 4 through a circuit 18, the load pressure of the righthand actuator 5 is not related at all to the pressure compensation and such load pressure is not applied to the load pressure detection circuit 11, so that, when the load pressure of the lefthand actuator 5 is high at the time of simultaneously operating two actuators shown in FIG. 1, the high load pressure is applied to the pressure receiving portion c of the pressure reducing valve 7 and, hence, the pressure compensation valve unit 3 tends to output a high pressure corresponding to the high load pressure. However, since the output side of the check valve 6 is connected to the righthand actuator 5 of low load pressure, much oil flows.

On the other hand, when the load pressure of the right-hand actuator 5 is high, the high load pressure does not act on the pressure receiving portion c, on which low lefthand pressure load acts, and hence, the pressure compensation valve unit outputs a pressure corresponding to the low load pressure to thereby operate only the lefthand actuator 5 (when the lefthand actuator reaches its stroke end, the righthand actuator is operated). In the load pressure detection circuit 11, the low load pressure is detected and the hydraulic pump provides a capacity corresponding to this low load pressure.

The above matters will be applicable to a case where pressure oil is supplied to three or more actuators.

In the foregoing explanation, the reason why the capacity of the hydraulic pump is made to a value corresponding to the load pressure is to reduce the capacity of the hydraulic pump 1 at the neutral position of the directional control valve 4 so as to reduce drive horse power loss of the hydraulic pump because the directional control valve is of a closed center type structure capable of blocking up the pump port 4*a* at the neutral position of the directional control valve 4. It is not necessary to locate the load pressure detection circuit 11 in a case where the above matter is ignored, an unload valve is disposed, or a directional control valve of an open center type structure is utilized in which the pump port 4*a* is communicated with the tank in an operation at the neutral position of the directional control valve.

The present invention was conceived to improve the above-mentioned defects and to provide a pressure compensation valve unit and a pressure oil supply system capable of supplying pressure oil to a plurality of actuators regardless of the magnitude of the load pressure, whereby the number of the compensation valves can be reduced less than the number of the actuators, thus reducing manufacturing cost.

DISCLOSURE OF THE INVENTION

To achieve the objects described above, according to the first embodiment of the present invention, there is provided a pressure compensation valve unit comprising a check valve which is pushed in an opening direction thereof by an inlet side pressure and in a closing direction thereof by an outlet side pressure and a pressure reducing valve actuating to establish communication between the inlet side and the outlet side and block the communication therebetween, pushed in the blocking up direction by a pressure in a pressure receiving chamber to push the check valve in the closing direction thereof, pushed in the communication direction with a highest pressure in a plurality of pressures by a pressure selective receiving means, and communicating the outlet side with the pressure chamber.

According to the above structure, since the pressure reducing valve of the pressure compensation valve unit is pushed in the direction communicating the inlet and outlet sides by the highest load pressure in the plurality of load pressures, the pressure compensation of the supply pressure oil can be performed by the highest load pressure in the plurality of load pressures.

Therefore, the pressure oil can be supplied to the plurality of actuators regardless of the magnitude of the load pressure even if the pressure oil is supplied to the plurality of actuators through one pressure compensation valve unit, so that the number of the pressure compensation valve unit is reduced less than that of the actuators, reducing the cost.

In the above structure, it is desired that the pressure selective receiving means is provided with a slider for pushing the pressure reducing valve in the communication direction thereof and a pressure receiving portion adapted to receive a pressure for pushing the pressure reducing valve in the communication direction and wherein when a pressure acting on the slider is higher than a pressure acting on the pressure receiving portion, the pressure reducing valve is pushed by the slider in the communication direction thereof.

Otherwise, it is desired that the pressure selective receiving means comprises a pressure receiving portion receiving a pressure for pushing the pressure reducing valve in the communication direction and a high pressure priority valve for supplying a pressure oil on the highest pressure side in a plurality of pressure oils to the pressure receiving portion.

According to the second embodiment of the present invention, there is provided a pressure compensation valve unit which comprises:

a check valve provided with a check valve bore to which an inlet port and an outlet port are opened and a spool inserted into the check valve bore, adapted to communicate the inlet port with the outlet port and to block the communication therebetween, pushed in the communication direction by a pressure at the inlet port and pushed in the blocking up direction by a pressure at the outlet port; and a pressure reducing valve provided with a pressure reducing valve bore to which a first port and a second port are opened, a spool inserted into the pressure reducing valve port, adapted to communicate the first port with the second port and to block the communication therebetween and having a small diameter rod opposing to the check valve, a third pressure receiving chamber receiving a pressure for pushing the spool in the blocking up direction through the communication with the second port, and first and second pressure receiving chambers formed on both end sides of a free piston slidably fitted to the small diameter rod and adapted to receive a pressure for pushing the spool in the communication direction thereof, wherein load pressures of different actuators are introduced into the first and second pressure receiving chambers.

In addition to this structure, it may be desired that a plurality of free pistons are fitted to the small diameter rod of the spool of the pressure reducing valve, a further pressure receiving chamber for receiving a pressure for pushing the spool in the communication direction is formed between the adjacent free pistons, and load pressures of other actuators to the other pressure receiving chambers are introduced.

According to the third embodiment of the present invention, there is provided a pressure oil supply system wherein a pressure compensation valve unit is disposed in a discharge passage of a hydraulic pump, the pressure compensation valve unit comprising:

a check valve which is pushed in an opening direction thereof by an inlet side pressure and in a closing direction thereof by an outlet side pressure and a pressure reducing valve actuating to establish communication between the inlet side and the outlet side and block the communication therebetween, pushed in the blocking up direction by a pressure in a pressure receiving chamber to push the check valve in the closing direction thereof, pushed in the communication direction with a highest pressure in a plurality of pressures by a pressure selective receiving means, and communicating the outlet side with the pressure chamber;

a plurality of actuators are connected to the output side of the pressure compensation valve unit through a plurality of directional control valves;

the discharge passage of said hydraulic pump is connected to the inlet side of the pressure reducing valve of the pressure compensation valve unit; and load pressure of the respective actuators are introduced into the pressure selective receiving means so as to push the pressure reducing valve by the highest load pressure.

In this structure, it is also desired that the pressure selective receiving means is provided with a slider for pushing the pressure reducing valve in the communication direction and a pressure receiving portion receiving a pressure for pushing the pressure reducing valve in the communication direction and wherein when a pressure acting on the slider is higher than a pressure acting on the pressure receiving portion, the pressure reducing valve is pushed in the communication direction by the slider.

Otherwise, it is desired that the selection pressure receiving means comprises a pressure receiving portion receiving a pressure for pushing the pressure reducing valve in the communication direction and a high pressure priority valve for supplying a pressure oil on the highest pressure side in a plurality of pressure oils to the pressure receiving portion.

According to the fourth embodiment of the present invention, there is provided a pressure oil supply system provided with a pressure compensation valve unit comprising:

a check valve provided with a check valve bore to which an inlet port and an outlet port are opened and a spool inserted into the check valve bore, adapted to communicate the inlet port with the outlet port and to block the communication therebetween, pushed in the communication direction by a pressure at the inlet port and pushed in the blocking up direction by a pressure at the outlet port; and a pressure reducing valve provided with a valve bore for the pressure reducing valve to which a first port and a second port are opened, a spool inserted into the pressure reducing valve port, adapted to communicate the first port with the second port and to block the communication therebetween and having a small diameter rod opposing to the check valve, a third pressure receiving chamber receiving a pressure for pushing the spool in the blocking up direction through the communication with the second port, and first and second pressure receiving chambers formed on both end sides of a free piston slidably fitted to the small diameter rod and adapted to receive a pressure for pushing the spool in the communication direction thereof; and wherein a plurality of actuators are connected to the output side of the pressure compensation valve unit through a plurality of directional control valves;

the discharge passage of the hydraulic pump is connected to the inlet side of the pressure reducing valve of the pressure compensation valve unit; and load pressure of different actuators are introduced into the first and second pressure receiving chambers of the pressure reducing valve to thereby push the pressure reducing valve in the communication direction with the highest load pressure.

In this structure, it is also desired that a plurality of free pistons are fitted to the small diameter rod of the spool of the pressure reducing valve, a further pressure receiving chamber for receiving a pressure for pushing the spool in the communication direction is formed between the adjacent free pistons, and load pressures of other actuators to the other pressure receiving chambers are introduced.

In the above third and fourth embodiment, it is also desired that a load pressure detection line is connected to the outlet side of the pressure reducing valve.

BRIEF DESCRIPTION OF THE DRAWINGS

The present invention will be understood more clearly by the detailed explanation described hereinafter and with reference to the accompanying drawings representing embodiments of the present invention. Further, the embodiments shown in the drawings are not made to specify the invention and made for easy understanding of the invention.

In the accompanying drawings.

BEST MODE FOR EMBODYING THE INVENTION

Hereunder, the pressure compensation valve unit and a pressure oil supply system provided with the pressure compensation valve unit according to preferred embodiments of the present invention will be described with reference to the accompanying drawings.

Figure 1:
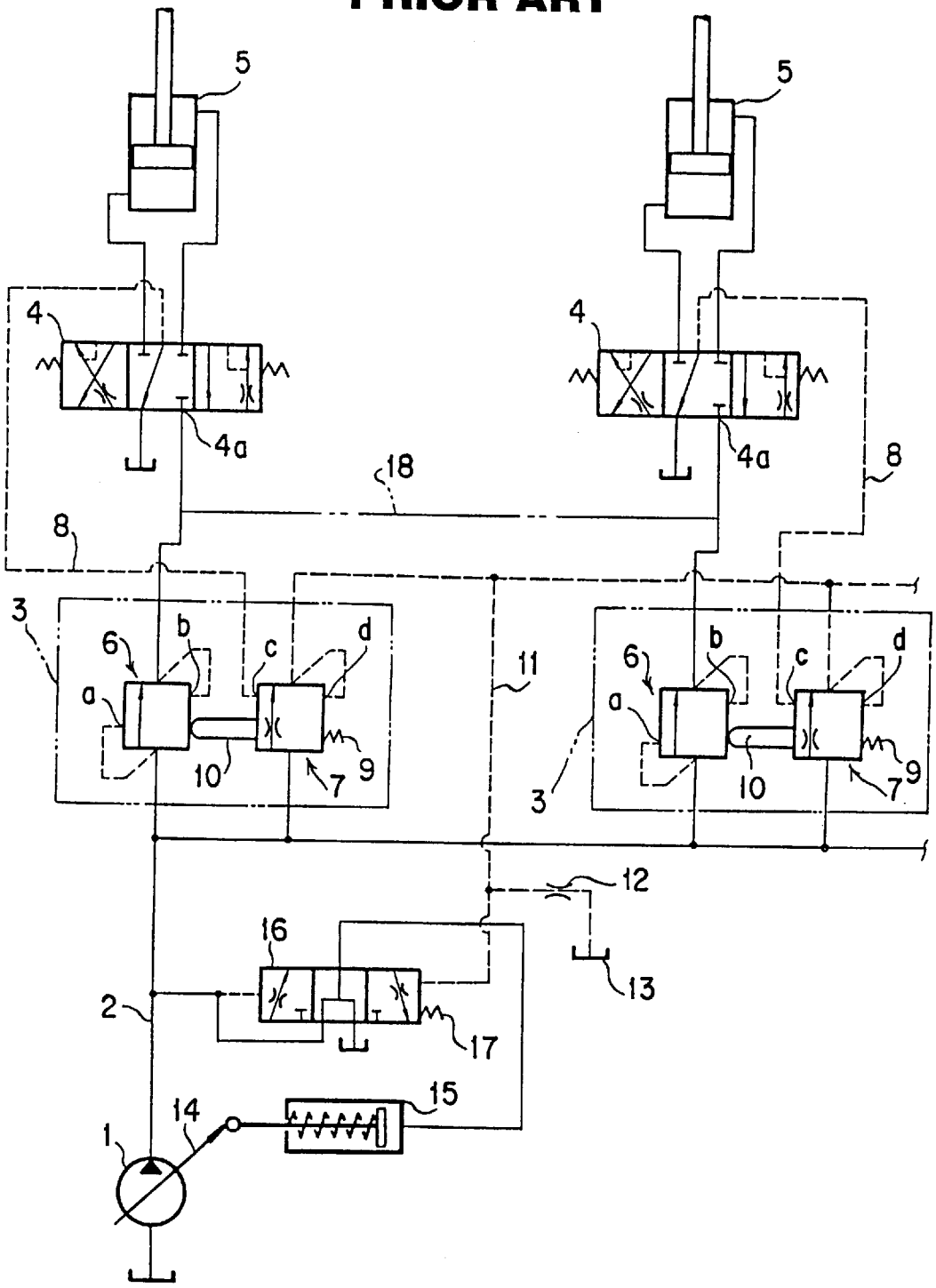
FIG. 1 PRIOR ART
FIG. 1 is a hydraulic circuit diagram utilizing a conventional pressure compensation valve unit.
Figure 2:
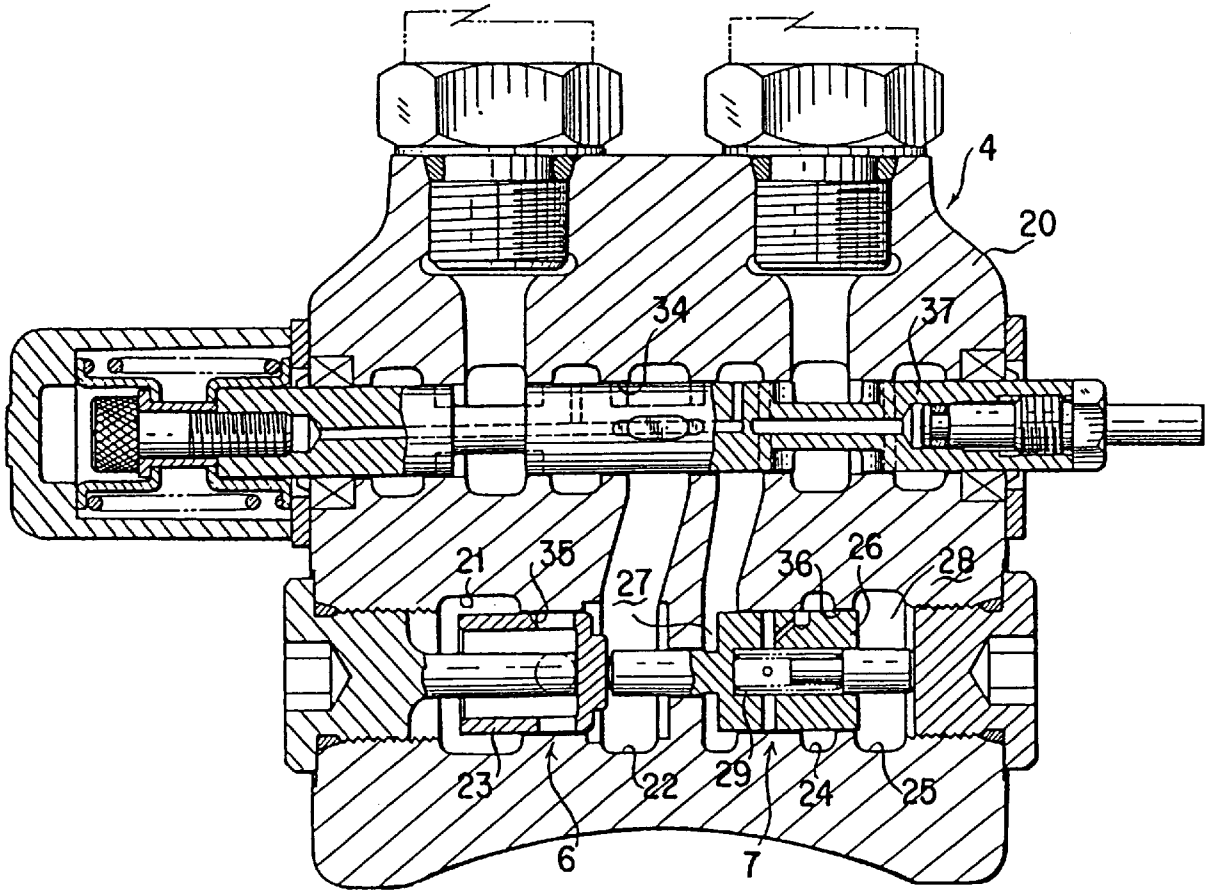
FIG. 2 PRIOR ART
FIG. 2 is a sectional view showing a concrete structure of the above conventional pressure compensation valve unit.

A first embodiment of the pressure oil supply system according to the present invention will be described with reference to FIG. 3, in which like reference numerals are added to members corresponding to conventional ones shown in FIG. 1 and detailed explanation thereof is omitted herein.

Figure 3:
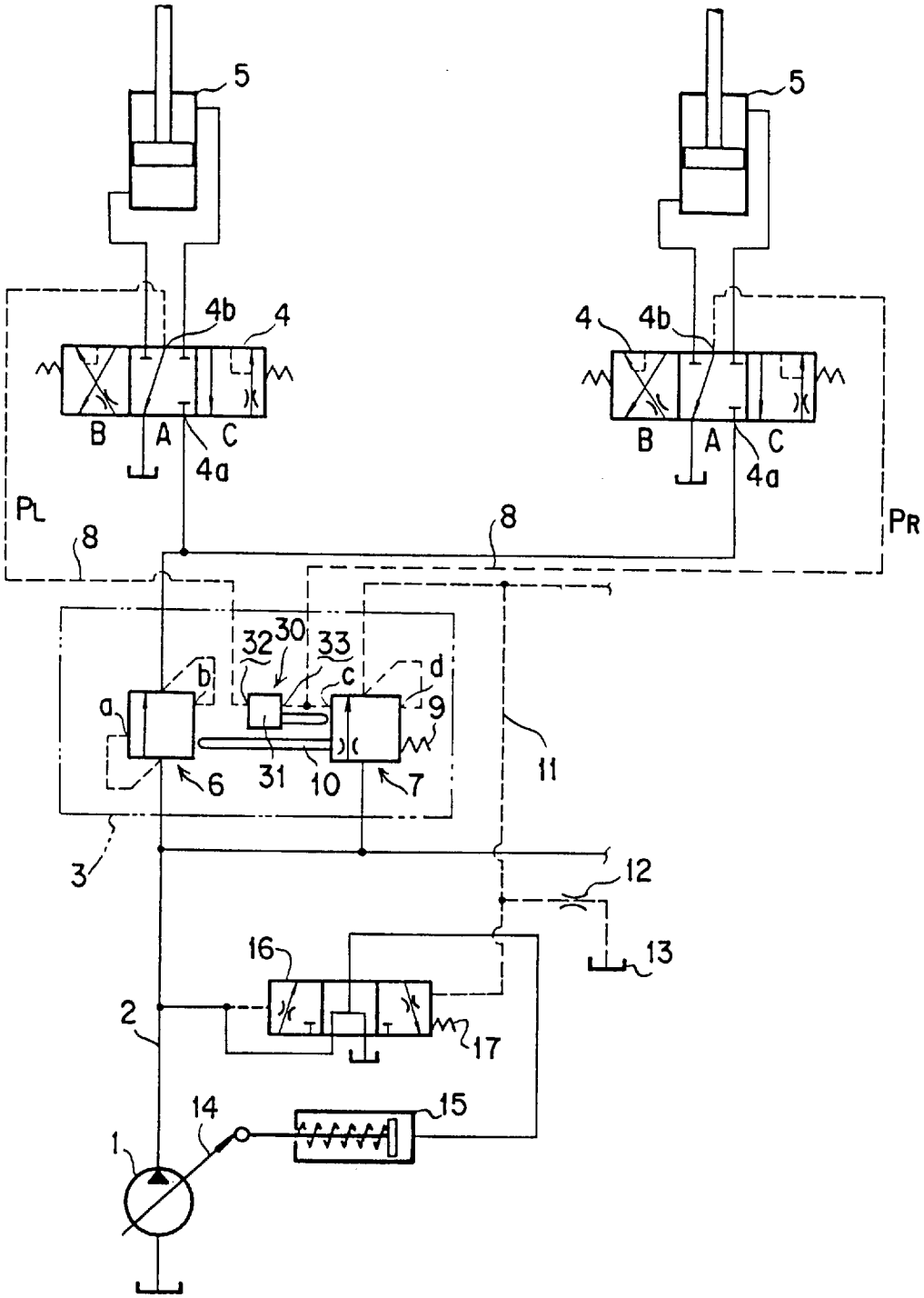
FIG. 3 is a hydraulic circuit diagram of a pressure oil supply system equipped with a compensation valve unit according to a first embodiment of the present invention.

As shown in FIG. 3, on the side of the pressure receiving portion c of the pressure reducing valve 7 of the compensation valve unit 3, is disposed a pressure selective receiving means 30 for pressing the pressure reducing valve 7 in a direction for communicating an inlet side and an outlet side thereof with the highest load pressure in load pressures of a plurality of actuators 5.

The pressure selective receiving means 30 is provided with a slider 31 disposed between the check valve 6 and the pressure reducing valve 7, and the slider 31 is slidable in a direction toward the pressure reducing valve 7 by the pressure on a first pressure receiving portion 32 and also slidable in a direction apart from the pressure reducing valve 7 by the pressure on a second pressure receiving portion 33. The first pressure receiving portion 32 is connected to a load pressure detection port 4*a* of one of the directional control valve 4 through a load pressure introducing passage 8, and the second pressure receiving portion 33 is communicated with the pressure receiving portion c of the pressure reducing valve 7 and connected to a load pressure detection port 4*b* of another one of the directional control valve 4 through another load pressure introducing passage 8.

Hereunder, the function of this embodiment will be described.

A load pressure PL of a lefthand actuator 5 in FIG. 3 acts on the first pressure receiving portion 32 of the slider 31 and a load pressure PR of a righthand actuator 5 acts on the second pressure receiving portion 33 of the slider 31 and the pressure receiving portion c of the pressure reducing valve 7.

Under the state, when the lefthand load pressure PL is higher than the righthand load pressure PR, the slider 31 is slid on the side of the pressure reducing valve 7 to press the pressure reducing valve 7 in a direction for communicating the inlet side with the outlet side thereof. On the other hand, when the righthand load pressure PR is higher than the lefthand load pressure PL, the slider 31 is slid in a direction apart from the pressure reducing valve 7 and, at the same time, the pressure reducing valve 7 is pressed by the righthand pressure PR acting on the pressure receiving portion c in a direction for communicating the inlet side with the outlet side thereof.

Accordingly, the pressure on the outlet side of the pressure compensation valve unit 3 is always compensated in pressure by the higher pressure of the lefthand load pressure PL or the righthand load pressure PR, and the outlet side pressure, i.e. load pressure, of the pressure reducing valve 7 corresponding to that higher pressure is detected by the load pressure detection passage 11, in response to which a capacity of the hydraulic pump 1 can be adjusted. Accordingly, in the time when both the lefthand and righthand actuators 5 are simultaneously actuated, the pressure of a pressure oil supplied can be compensated by the either higher one of the load pressures of the lefthand actuator 5 and the righthand actuator 5, thus supplying the pressure oil, and in such case, much amount of pressure oil is supplied to the actuator 5 on which a smaller load pressure is applied and the capacity of the hydraulic pump 1 corresponds to the higher load pressure, so that the pump discharge pressure increases in a short time to a pressure corresponding to the higher load pressure.

Figure 4:
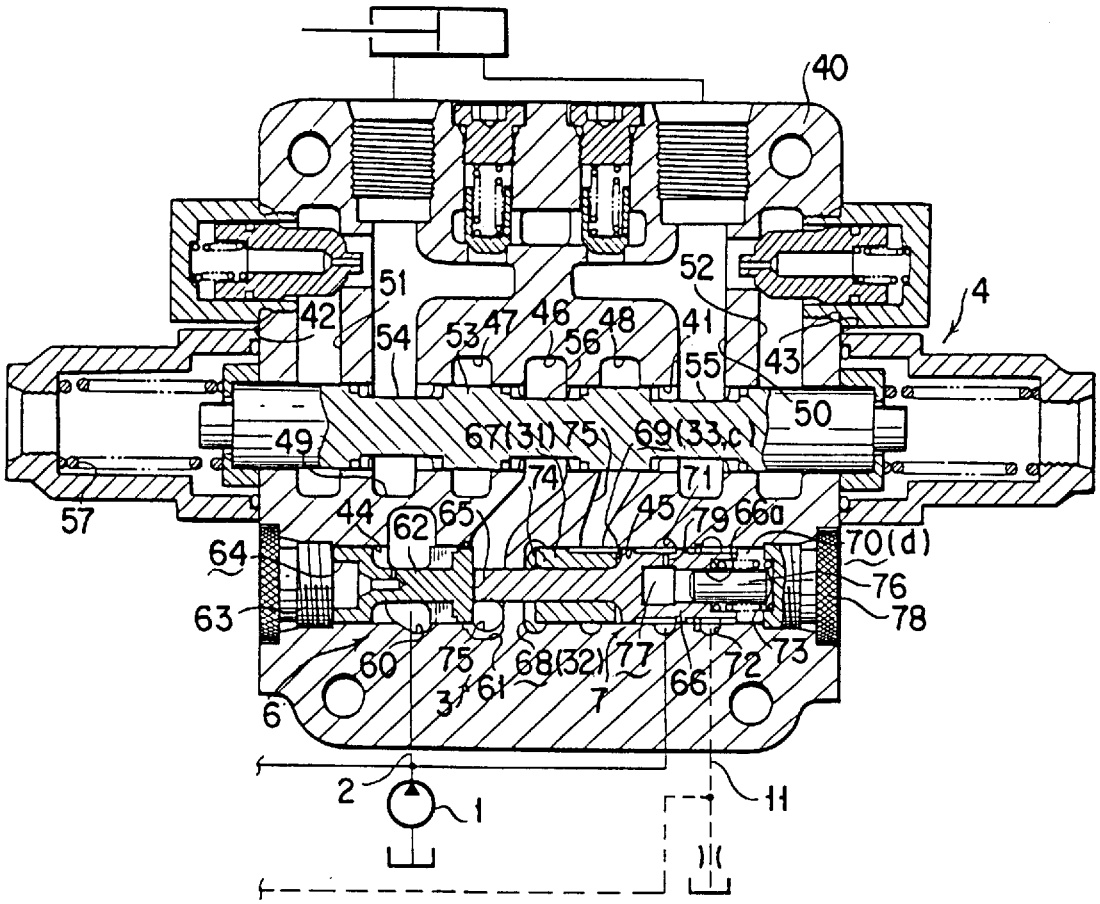
FIG. 4 is a sectional view showing a concrete structure of a directional control valve on one side in which the pressure compensation valve unit shown in FIG. 3 is assembled.

FIG. 4 shows a concrete structure of the pressure compensation valve unit 3 used for the pressure oil supply system, and the pressure compensation valve unit 3 is assembled in a valve block 40 of the directional control valve 4.

As shown in FIG. 4, the valve block 40 provides substantially a rectangular parallelopiped shape. A spool bore 41 is formed to an upper side portion of the valve block 40 and is opened at its left and right side surfaces 42 and 43 thereof, and on a lower side portion of the valve block 40, are concentrically formed a check valve bore 44 opened to the left side surface 42 and a pressure reducing valve bore 45 opened to the right side surface 43. The valve block 40 is formed with a pump port 46 opened to the spool bore 41, first and second load pressure detection ports 47 and 48, first and second actuator ports 49 and 50 and first and second tank ports 51 and 52. Into the spool port 41, is inserted a main spool 53 having first and second small diameter portions 54 and 55 and an intermediate small diameter portion 56. Further, the first and second load pressure detection ports 47 and 48 are communicated with each other.

The spool 53 is maintained at a neutral position A blocking up the respective ports by means of spring 57. When the spool 53 is slid in a rightward direction, the spool 53 takes a first pressure oil supply position B via which the second actuator port 50 is communicated with the second tank port 52 at the second small diameter portion 55, the pump port 46 is communicated with the second load pressure detection port 48 via the intermediate small diameter portion 56, and the first actuator port 49 is communicated with the first load pressure detection port 47 at the first small diameter portion 54. When the spool is slid in a leftward direction, the spool 53 takes a first pressure oil supply position C at which the first actuator port 49 is communicated with the first tank port 51 via the first small diameter portion 54, the pump port 46 is communicated with the first load pressure detection port 47 via the intermediate small diameter portion 56, and the second actuator port 50 is communicated with the second load pressure detection port 48 via the second small diameter portion 55. These structures constitutes the closed-center type directional control valve 4.

Into the bore 44 for the check valve 44, is inserted a spool 62 for establishing and blocking the communication between an inlet port 60 and an outlet port 61 both opened thereto. The spool 62 takes a blocking up position by means of a plug 63 so as not to be slid leftward from the illustrated position and is pushed to a communication position by an inlet pressure in the pressure receiving chamber 64, thus constituting the check valve 6. The outlet port 61 communicates with the pump port 46 and the discharge passage 2 of the hydraulic pump 1 is connected to the inlet port 60, and the outlet port 61 is opened to a mated face of the valve block 40 through a second communication hole 75.

A spool 66 provided with a rod 65 having a small diameter is inserted into the pressure reducing valve bore 45, and the small diameter rod 65 is opposed to the spool 62 of the check valve 6. Furthermore, a free piston 67 as a slider 31 shown in FIG. 3 is inserted into the small diameter rod 65, and first, second and third pressure receiving chambers 68, 69 and 70 are formed on both end sides and outer peripheral side of the free piston 67. The first pressure receiving chamber 68 corresponds to the first pressure receiving chamber 32 shown in FIG. 3, the second pressure receiving chamber 69 corresponds to the second pressure receiving chamber 33 and the pressure receiving portion c, and the third pressure receiving chamber 70 corresponds to the pressure receiving portion d shown in FIG. 3.

To the pressure reducing valve bore 45 are opened a first port 71 as an inlet port and a second port 72 as an outlet port, and the spool 66 is urged by a spring 73 having a weak spring force in a direction to block up the first and second ports 71 and 72. The discharge passage 2 of the hydraulic pump 1 is connected to the first port 72 and the load pressure detection passage 11 is connected to the second port 72. The first pressure receiving chamber 68 is opened to the mated face of the valve block 40 through the first communication hole 74 and the second pressure receiving chamber 69 is communicated with the second load pressure detection port 48 of the directional control valve 4 through an oil hole 75.

Referring to FIG. 4, the spool 66 of the pressure reducing valve 7 is provided with a central bore 66*a* into which the piston 67 is inserted to thereby constitute a pressure receiving chamber 77, which is opened to the first port 71 through a fine hole 79, so that the pump discharge pressure oil fills the pressure receiving chamber 77, and since the pressure oil in the pressure receiving chamber 77 is flowed out through a throttle 79 when the spool 66 is slid in the communication direction (leftward as viewed), the sliding speed of the spool 66 in the communication direction is made slow.

This is a structure for slowly operating the pressure reducing valve 7 at the time of variation of the load pressure and for making gentle the pressure variation of the pump discharge pressure, and hence, this structure may be eliminated.

As mentioned above, when the high pressure oil is flowed in the first pressure receiving chamber 68, the free piston 67 is slid rightwardly and presses the spool 66 in a direction for establishing the communication between the first and second ports 71 and 72. On the other hand, when the highly pressurized oil is flown in the second pressure receiving chamber 69, the free piston 67 is slid leftwardly to the stroke end position and presses the spool 66 in a direction for establishing the communication between the first and second ports 71 and 72, thus performing the same function as that of the pressure compensation valve unit shown in FIG. 3.

Figure 5:
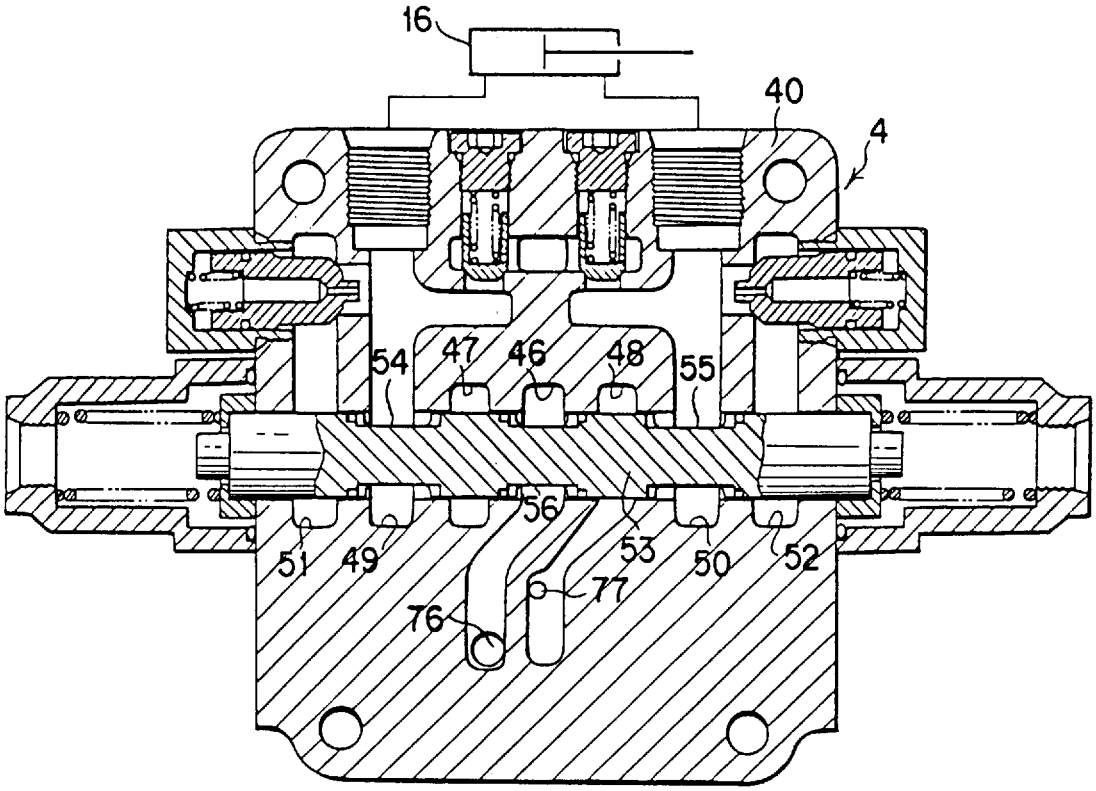
FIG. 5 is a sectional view showing a concrete structure of the directional control valve on the other side thereof.
Figure 6:
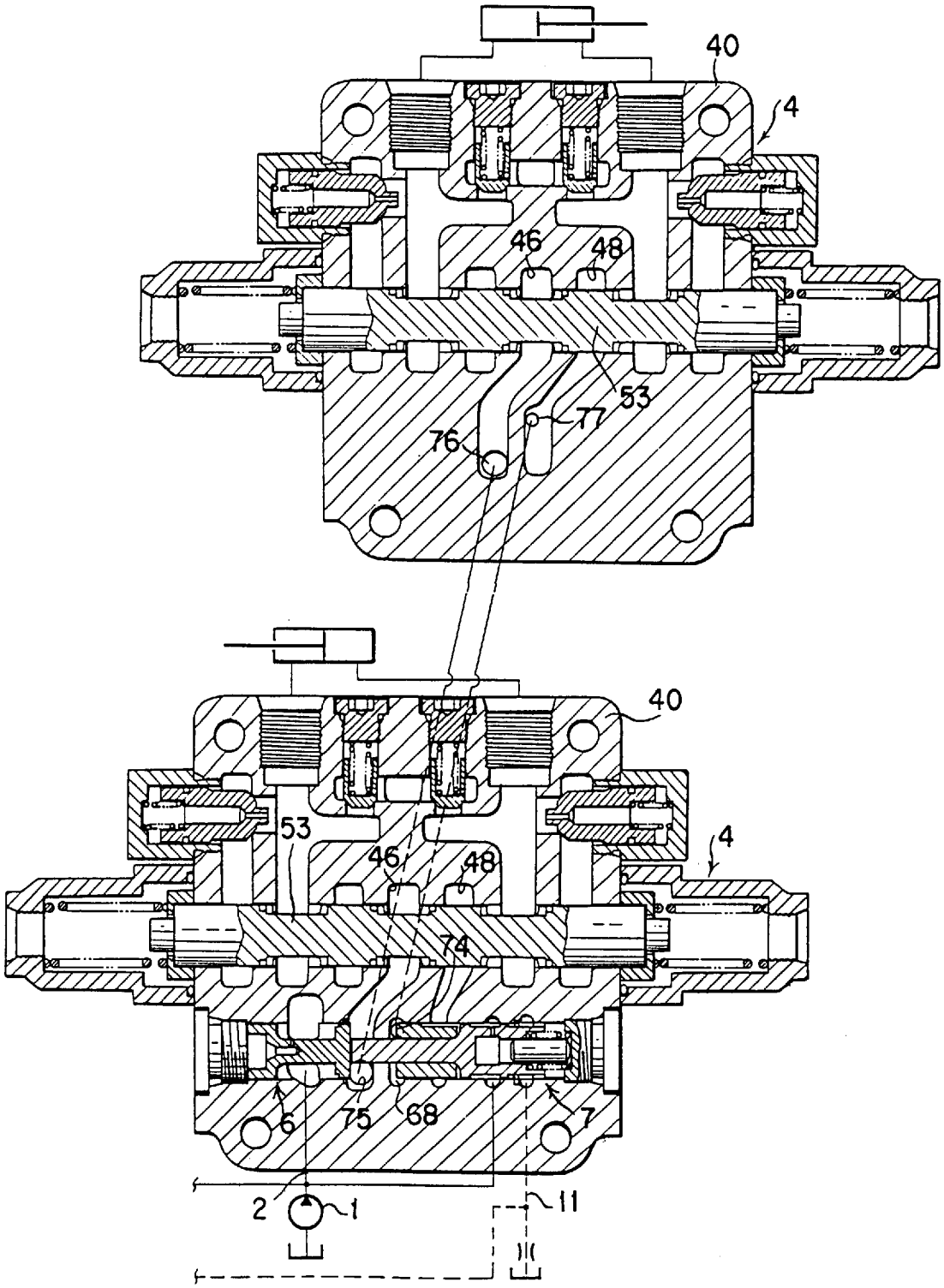
FIG. 6 is a sectional view showing a concrete structure of the pressure supply system shown in FIG. 3.

The righthand directional control valve 4 concretely shown in FIG. 3 has a structure represented by FIG. 5. That is, the structure of the righthand directional control valve 4 is the same as that of the lefthand directional control valve 4. However, the valve block 40 of the directional control valve 4 is not provided with the pressure compensation valve unit 3, and the pump port 46 and the second load pressure detection port 48 are opened to the mated face of the valve block 40 through a third communication hole 76 and a fourth communication hole 77, respectively. Further, as shown in FIG. 6, when the valve blocks 40 of the righthand and lefthand directional control valves 4 are connected through the mated faces of both the valve blocks, the first communication hole 74 and the fourth communication hole 77 are communicated with each other, so that the pressure at the second load pressure detection port 48 of the righthand directional control valve 4, i.e. the righthand load pressure, flows in the first pressure receiving chamber 68, and the second communication hole 75 and the third communication hole 76 are then communicated with each other, so that the outlet side of the pressure compensation valve unit 3 is communicated with the pump port 46 of the righthand directional control valve 4 and the output pressure (compensation pressure) of the pressure compensation valve unit 3 also flows in the pump port 46 of the righthand directional control valve 4.

According to the structure described above, the valve blocks 40 are connected to each other without arranging the load pressure introducing passage 8 and the circuit line 8 shown in FIG. 3 as external line arrangement, thus making simple the line structure arrangement.

Furthermore, as shown in FIG. 5, since the valve block 40 of one of the directional control valves 4 has an extra space for incorporating the pressure compensation valve unit 3, this space can be utilized for locating other elements such as other valve means.

Figure 7:
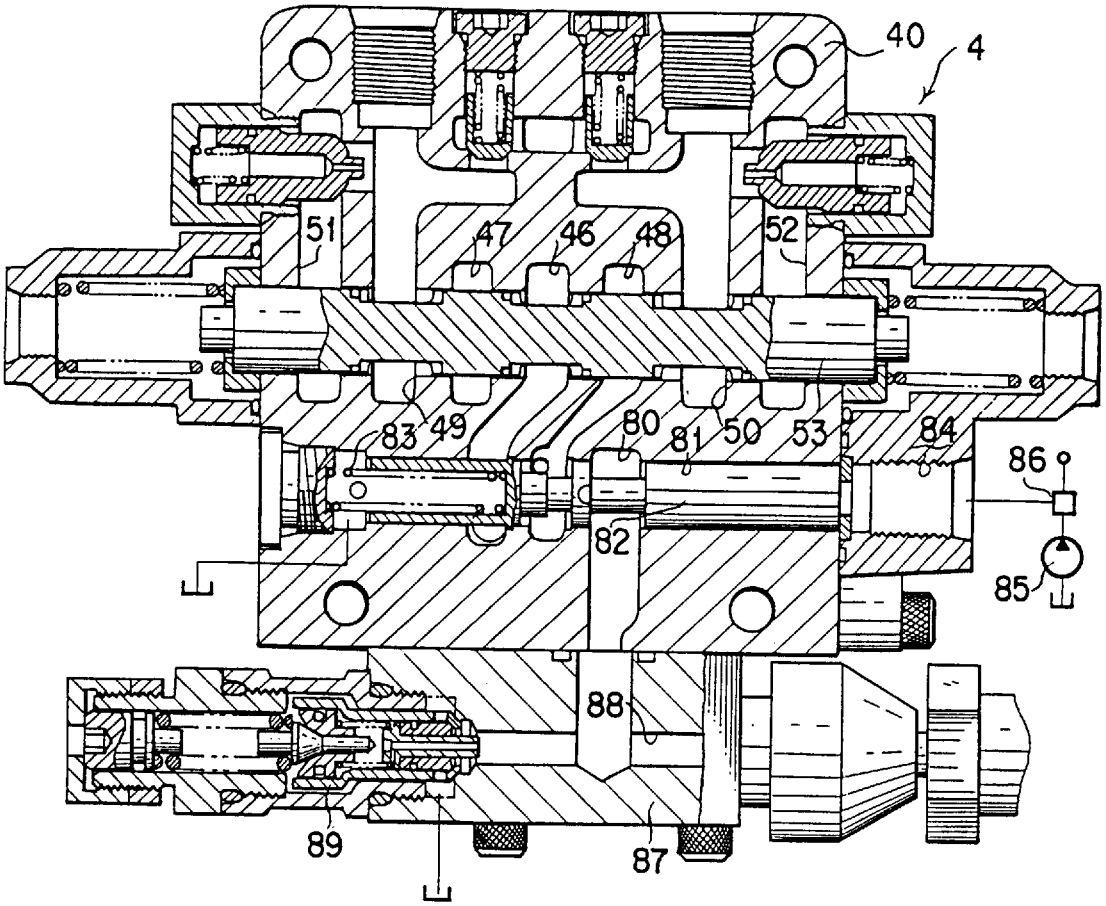
FIG. 7 is a sectional view showing another example of a directional control valve on the other side thereof.

For example, as shown in FIG. 7, the valve block 40 is formed with an auxiliary actuator port 80, and an auxiliary spool bore 81 is also formed through the auxiliary actuator port 80, the second load pressure detection port 48 and the pump port 46. An auxiliary spool 82 is inserted into the auxiliary spool bore 81, and the auxiliary spool 82 is held in an intermediate position blocking up these three ports by means of a spring 83 and is slid to take a position for communicating these three ports by supplying a pressure oil of a hydraulic pump 85 into a pilot pressure receiving chamber 84 through a pilot valve 86. Furthermore, the auxiliary actuator port 80 is communicated with an oil hole 88 of a block 87 connected to the valve block 40, and a relief valve 89 is provided for the block 87.

According to the structure described above, the output pressure of the pressure compensation valve unit 3 can be supplied to the oil hole 88 by sliding the auxiliary spool 82 between the neutral position and the communication position thereof through the actuation of the pilot valve 86, and for example, the directional control valve 4 can be constructed as a control valve including no return circuit such as hydraulically operational breaker.

Further, in a modification, a relief valve may be provided for the valve block 40. An inlet opening opened on the inlet side of the relief valve may be formed to the mated face of the valve block 40 so that the inlet opening is communicated with the inlet opening 60 of the valve block 40 provided for the pressure compensation valve unit 3 and the discharge side of the relief valve is communicated with the first tank port 51 or the second tank port 52.

According to this modified arrangement, the relief valve of the hydraulic pump 1 will be incorporated in the valve block 40 of the directional control valve 4.

In a further modification, an unload valve may be provided for the valve block 40. A first inlet opening opened on the inlet side of the unload valve and a second inlet opening opened on the side of the pressure receiving portion are formed to the mated surface of the valve block 40, respectively, so that the first inlet opening is communicated with the inlet opening 60 of the valve block 40 provided for the pressure compensation valve unit 3 and the second inlet opening is communicated with the second port 72 and so that the discharge side of the unload valve is communicated with the first tank port 51 or the second tank port 52.

According to this modified arrangement, the unload valve of the hydraulic pump 1 will be incorporated in the valve block 40 of the directional control valve 4.

Figure 8:
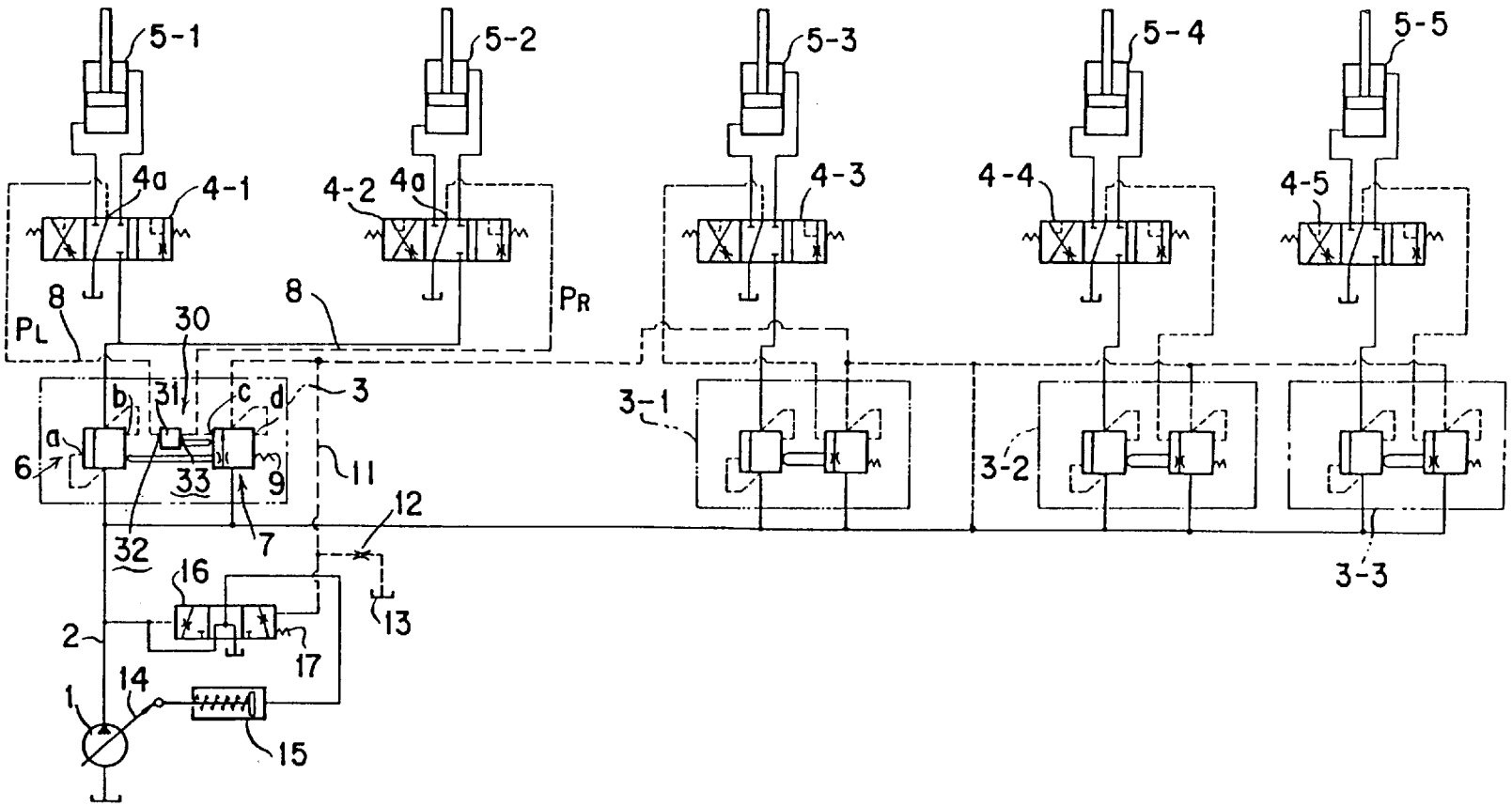
FIG. 8 is a hydraulic circuit diagram of a pressure oil supply system equipped with a compensation valve unit according to a second embodiment of the present invention.

FIG. 8 represents the second embodiment of the pressure oil supply system according to the present invention. In this embodiment, a first directional control valve 4-1 and a second directional control valve 4-2 are connected to the discharge passage 2 of the hydraulic pump 1 through the pressure compensation valve unit 3 according to the present invention of the structure shown in FIG. 3, and furthermore, a third directional control valve 4-3, a forth directional control valve 4-4 and a fifth directional control valve 4-5 are connected to the discharge passage 2 of the hydraulic pump 1 respectively through the conventional first, second and third pressure compensation valve units 3-1, 3-2 and 3-3 shown in FIG. 1.

A first actuator 5-1 is a blade cylinder of a hydraulic power shovel, a second actuator 5-2 is a boom swing cylinder, a third actuator 5-3 is an arm cylinder, a fourth actuator 5-4 is a bucket cylinder and a fifth actuator 5-5 is a boom cylinder. A blade cylinder as the first actuator 5-1 is less used in frequency based on working nature of the power shovel.

According to the above structure, the outlet side of the pressure reducing valve 7 of the pressure compensation valve unit 3 of the present invention is connected to all of the outlet sides of the pressure reducing valves 7 of the first, second and third pressure compensation valve units 3-1, 3-2 and 3-3 and also connected to the load pressure detection circuit 11, so that when all of the actuators 5-1 to 5-5 are operated simultaneously, the highest load pressure is detected by the load pressure detection circuit 11 and the highest load pressure is introduced to the pressure receiving portions d of the pressure reducing valves 7 of the respective pressure compensation valve units.

As mentioned above, when one of the actuators 5-1 and 5-2 and at least one of the actuators 5-1 to 5-3 are operated simultaneously, the discharge pressure oil from the hydraulic pump 1 can be distributed to the respective actuators as like as in the case of location of five pressure compensation valve units.

Figure 9:
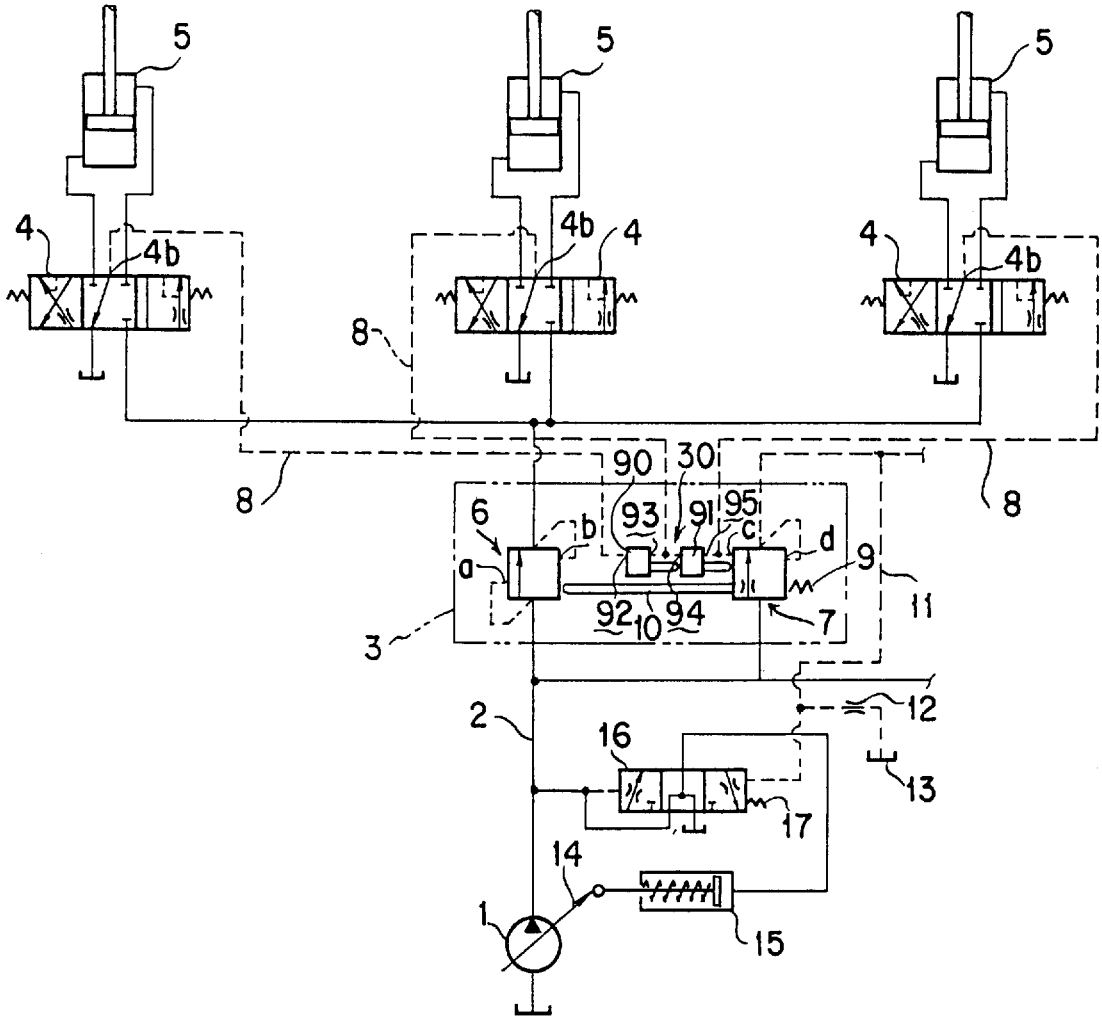
FIG. 9 is a hydraulic circuit diagram of a pressure oil supply system equipped with a compensation valve unit according to a third embodiment of the present invention.

FIG. 9 represents the third embodiment of the pressure oil supply system according to the present invention. In this embodiment, three actuators 5 are connected respectively to the output side of the pressure compensation valve unit 3 through three directional control valves 4.

In this arrangement, because of the reason that it is necessary to push the pressure reducing valve 7 of the pressure compensation valve unit 3 in the communication direction thereof by the highest load pressures among the load pressures of the three actuators, the pressure selective receiving means 30 is composed of a first slider 90 and a second slider 91 which are operatively connected to each other, wherein a first pressure receiving portion 92 pushing the first slider 90 toward the second slider 91 is connected to the load pressure detection port 4*b* of one of the directional control valves 4 through the load pressure introducing passage 8, a second pressure receiving portion 93 of the first slider 90 and a first pressure receiving portion 94 of the second slider 91 are connected to another load pressure detection port 4*b* of another directional control valve 4 through another load pressure introducing passage 8, and a second pressure receiving portion 95 of the second slider 91 and the pressure receiving portion c of the pressure reducing valve 7 are connected to still another load pressure detection port 4*b* of the remaining directional control valve 4 through still another load pressure introducing passage 8.

According to the arrangement described above, when the load pressure acting on the first pressure receiving portion 92 is the highest one, the first slider 90 pushes the pressure reducing valve 7 toward the communication direction thereof through the second slider 91, when the load pressure acting on the second pressure receiving portion 93 and the first pressure receiving portion 94 is the highest one, the second slider 91 pushes the pressure reducing valve 7 in the communication direction thereof after the first slider 90 is pushed leftwardly to its stroke end portion, and when the load pressure acting on the second pressure receiving portion 95 and the pressure receiving portion c is the highest one, the pressure reducing valve 7 is pushed toward the communication direction thereof after the first and second sliders 90 and 91 are pushed to the stroke end portions.

As mentioned above, it is allowed to locate only one pressure compensation valve unit 3 for three actuators 5, and at a time when two or three actuators 5 are simultaneously operated, the pressure compensation of the supply pressure oil can be done by the highest load pressure.

Figure 10:
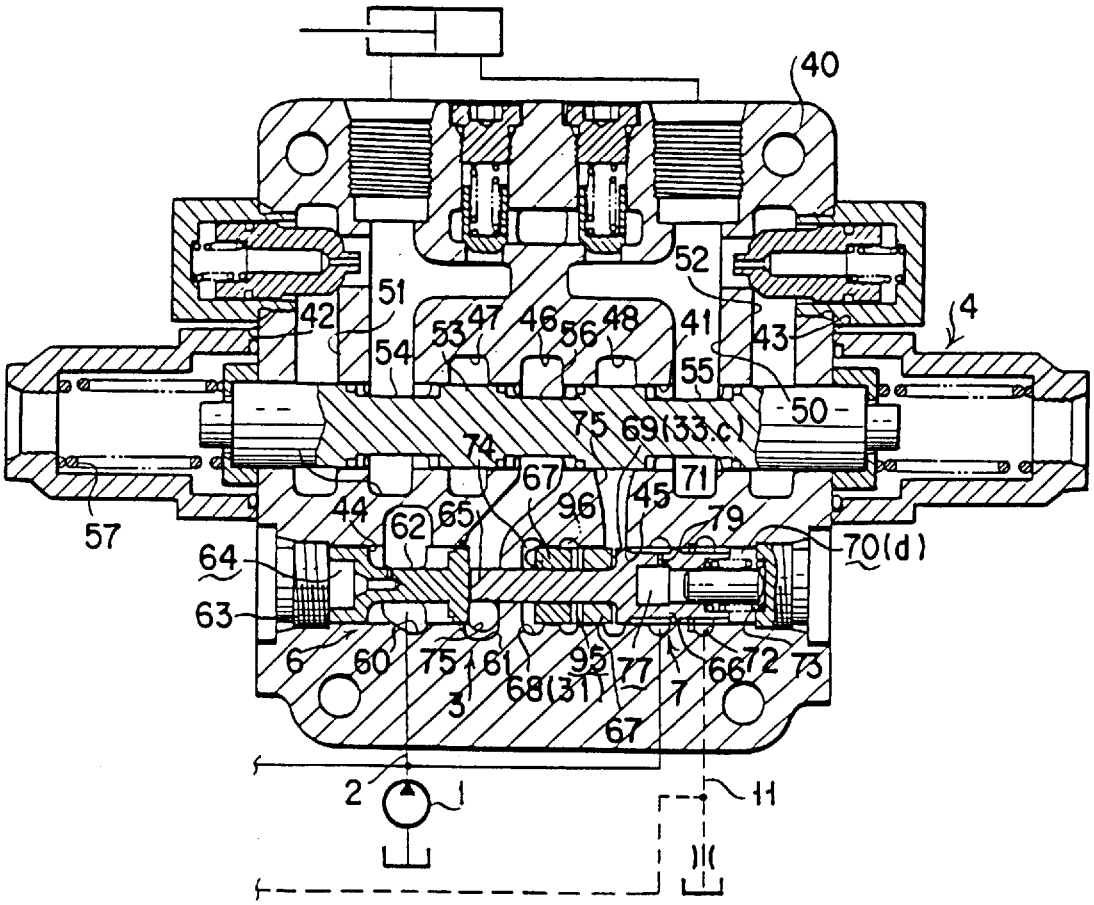
FIG. 10 is a sectional view showing a concrete structure of a directional control valve on one side in which the pressure compensation valve unit shown in FIG. 9 is assembled.

FIG. 10 shows a concrete structure of the pressure compensation valve unit 3 used for the third embodiment described above. As like the structure shown in FIG. 4, the pressure compensation valve unit 3 is provided for the valve block 40 of the directional control valve 4, and two free pistons 67 are fitted, in the axial direction thereof, to the small diameter rod 65 of the spool 66 constituting the pressure reducing valve 7 to form a fourth pressure receiving chamber 95 between the adjacent free pistons 67. This fourth pressure receiving chamber 95 corresponds to the second pressure receiving portion 93 and the first pressure receiving portion 94 shown in FIG. 9 and is opened to the mated face of the valve block 40 through a fifth communication hole 96.

Figure 11:
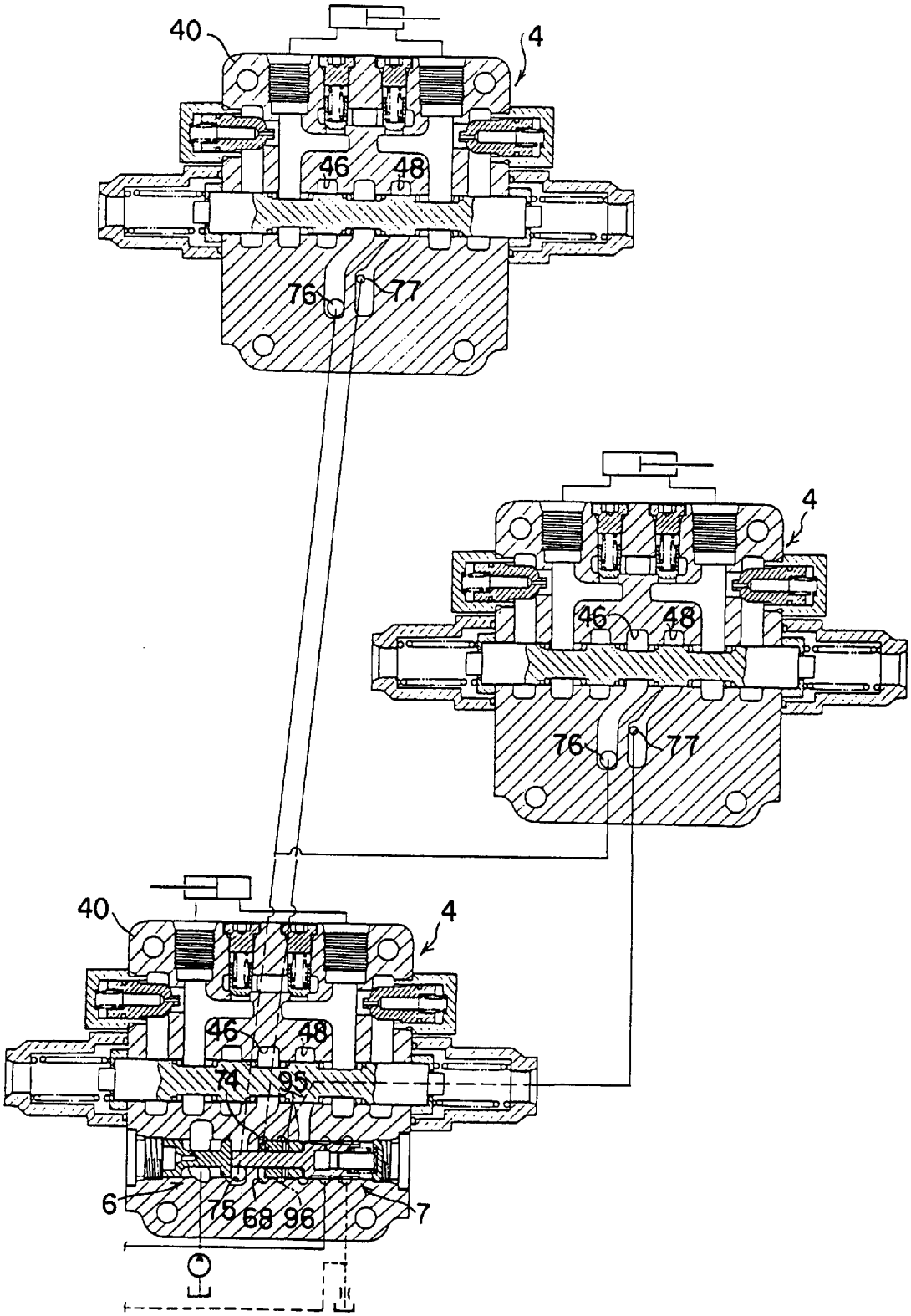
FIG. 11 is a sectional view showing a concrete structure of the pressure supply system shown in FIG. 9.

Furthermore, as shown in FIG. 11, the remaining two directional control valves 4 of the three ones shown in FIG. 9 has substantially the same structure as that of the directional control valve 4 described with reference to FIG. 5, and the valve block 40 of one of these directional control valves 4 is connected to one of the mated faces of the valve block 40 of the directional control valve 4 provided with the pressure compensation valve unit 3, the valve block 40 of the other directional control valve 4 is connected to the other mated face of the valve block 40 of the directional control valve 4 provided with the pressure compensation valve unit 3, the second communication hole 75 of the valve block 40 of the directional control valve 4 provided with the pressure compensation valve unit 3 is communicated with the third communication holes 76 of the valve blocks 40 of two directional control valves 4, respectively, the first communication hole 74 is communicated with the fourth communication hole 77 of the valve block 40 of one of the above directional control valves 4, and the third communication hole 99 is communicated with the fourth communication hole 77 of the valve block 40 of the other directional control valve 4.

According to such arrangement, the output pressure (pressure oil compensated in pressure) of the pressure compensation valve unit 3 is supplied to the pump ports 46 of the directional control valves 4 by coupling, in a mated state, the respective valve blocks 40, and the pressure (load pressure) of the second load pressure detection port 48 of one of the directional control valves 4 is supplied to the first pressure receiving chamber 68 and the pressure (load pressure) of the second load pressure detection port 48 of the other one of the directional control valve 4 is supplied to the third pressure receiving chamber 95. Accordingly, the arrangement of FIG. 11 attains substantially the same function as that of the pressure compensation valve unit 3 shown in FIG. 9.

Figure 12:
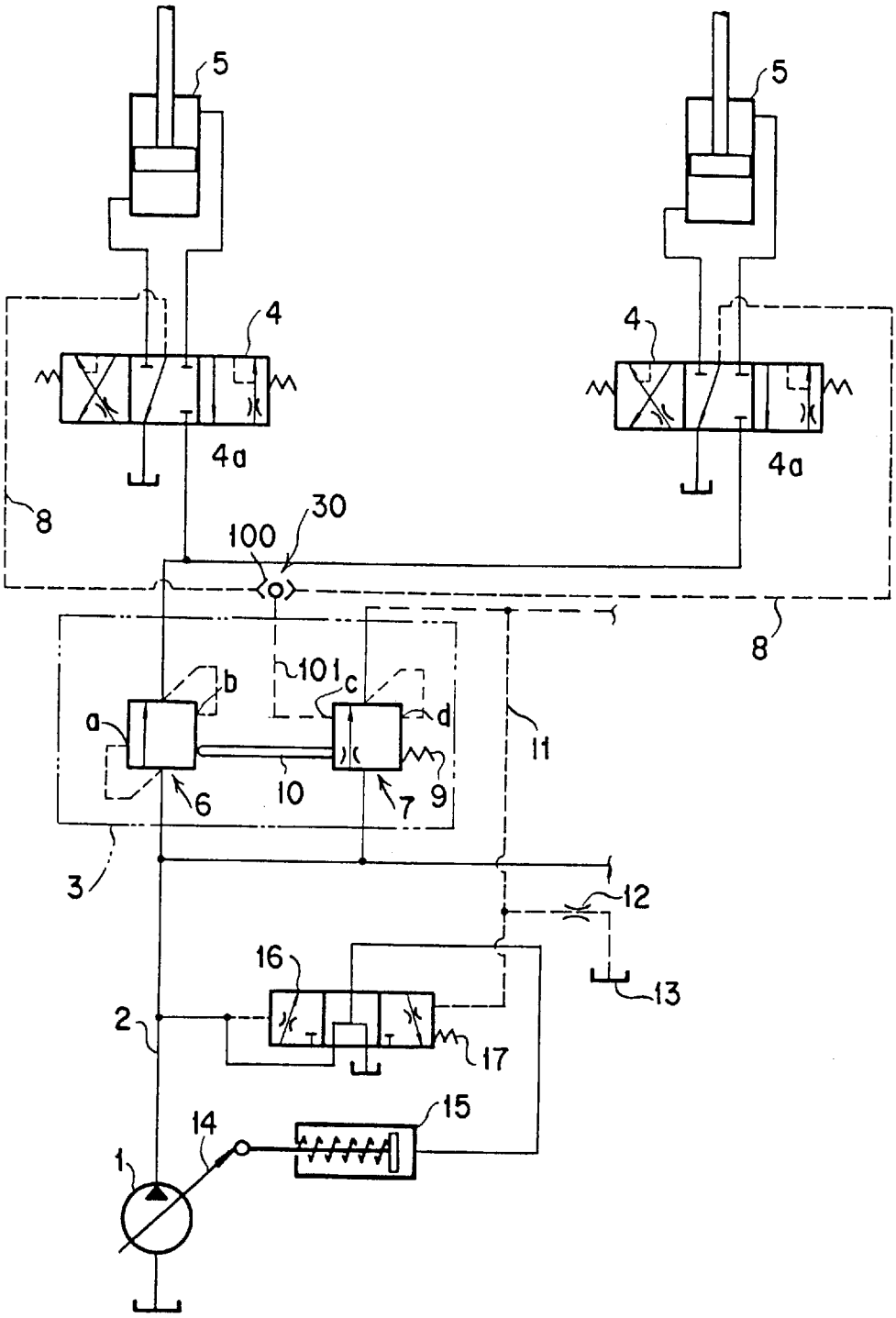
FIG. 12 is a hydraulic circuit diagram of a pressure oil supply system equipped with a compensation valve unit according to a fourth embodiment of the present invention.

FIG. 12 represents the fourth embodiment of the pressure oil supply system according to the present invention. In this embodiment, the pressure selective receiving means 30 is provided with a high pressure priority valve 100 having two inlets which are connected to the load pressure introducing passages 8, respectively, and an outlet which is connected to the pressure receiving portion c of the pressure reducing valve 7 through a circuit line 101. According to this arrangement, the highest load pressure is applied to the pressure receiving portion c of the pressure reducing valve 7 to thereby push the same in the communication direction.

Figure 13:
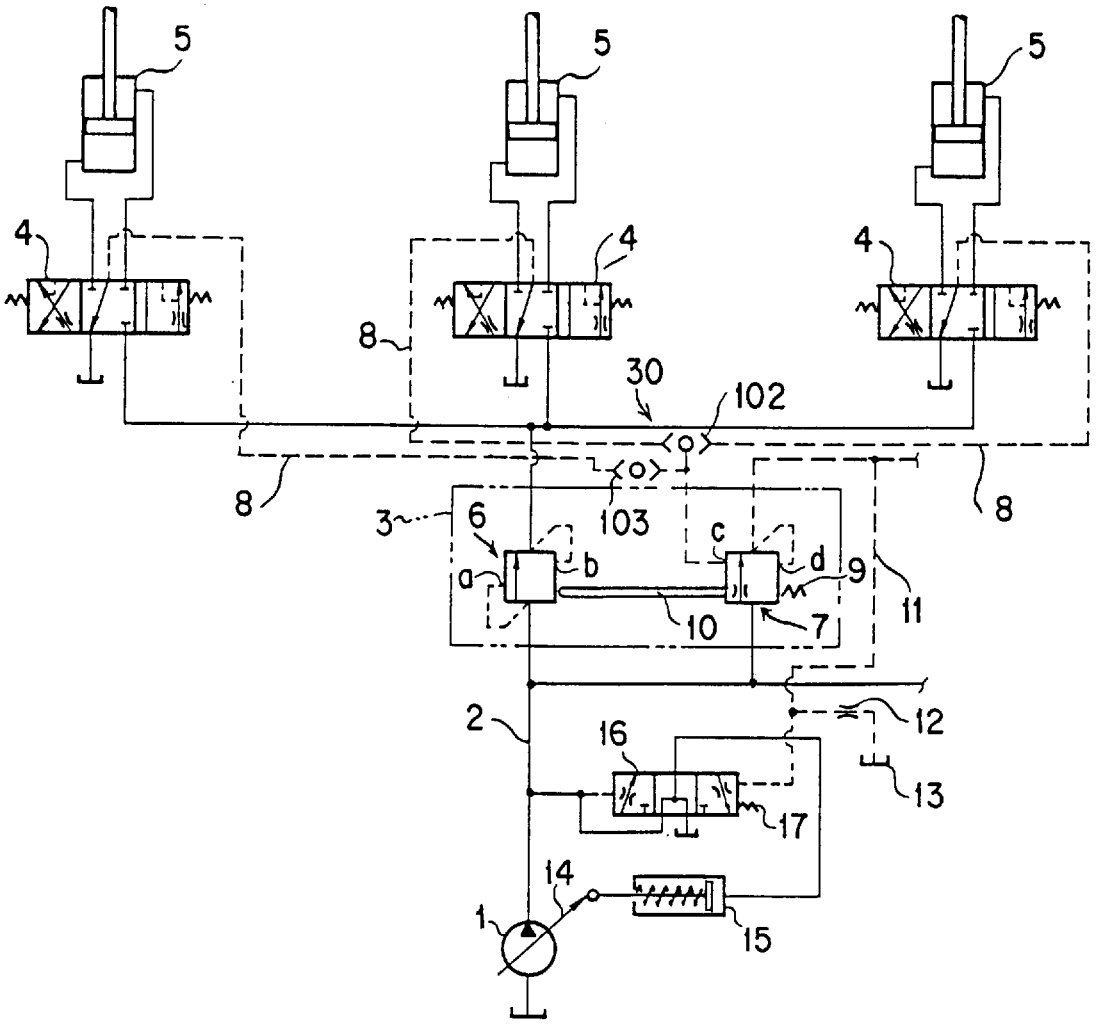
FIG. 13 is a hydraulic circuit diagram of a pressure oil supply system equipped with a compensation valve unit according to a fifth embodiment of the present invention.

FIG. 13 represents the fifth embodiment of the pressure oil supply system according to the present invention. In this embodiment, the pressure selective receiving means 30 is equipped with first and second high pressure priority valves 102 and 103, in which the first high pressure priority valve 102 has two inlets which are connected to one load pressure introducing passage 8, respectively, a circuit line 104 connected to an outlet thereof and the remaining load pressure introducing passage 8 are connected to two inlets of the second high pressure priority valve 102, and a circuit 105 connected to an outlet thereof is connected to the pressure receiving portion c of the pressure reducing valve 7. According to this arrangement, the highest one of the load pressures in the three load pressure introducing passages 8 is applied to the pressure receiving portion c of the pressure reducing valve 7 to thereby push the same in the communication direction.

As mentioned hereinabove, according to the present invention, since the pressure reducing valve 7 of the pressure compensation valve unit 3 is pushed in the direction communicating the inlet and outlet sides by the highest load pressure in the plurality of load pressures, the pressure compensation of the supply pressure oil can be performed by the highest load pressure in the plurality of load pressures.

Accordingly, since the pressure oil can be supplied to the plurality of actuators regardless of the magnitude of the load pressure even in the arrangement in which the pressure oil is supplied to the plurality of the actuators through one pressure compensation valve unit 3, the number of the pressure compensation valve unit 3 to be used can be reduced in comparison with the number of the actuators arranged, thus reducing the manufacturing cost.

Although the present invention has been illustrated and described with respect to exemplary embodiments thereof, it should be understood by those skilled in the art that the foregoing and various other changes, deletions and additions may be made thereto without departing from the scopes of the present invention. Therefore, the present invention should not be understood as limited to the specific embodiments described above but to include all possible embodiments which can be embody within a scope encompassed and equivalents thereof with respect to the features recited in the appended claims.

We claim:

1. A pressure compensation valve unit comprising:

a check valve which is pushed in an opening direction thereof by an inlet side pressure and in a closing direction thereof by an outlet side pressure; and means, including a pressure reducing valve, actuating to establish communication between the inlet side and the outlet side of the check valve and block the communication therebetween, said pressure reducing valve means being pushed in the blocking direction by a pressure in a pressure receiving chamber to push the check valve in the closing direction thereof, and being pushed in the communication direction with a highest pressure selected in a plurality of pressures by a pressure selective receiving means, and communicating said outlet side with said pressure receiving chamber.

2. A pressure compensation valve unit according to claim 1, wherein said pressure selective receiving means is provided with a slider for pushing said pressure reducing valve in the communication direction thereof and a pressure receiving portion adapted to receive a pressure for pushing the pressure reducing valve in the communication direction and wherein when a pressure acting on said slider is higher than a pressure acting on said pressure receiving portion, said pressure reducing valve is pushed by said slider in the communication direction thereof.

3. A pressure compensation valve unit according to claim 1, wherein said pressure selective receiving means comprises a pressure receiving portion receiving a pressure for pushing said pressure reducing valve in the communication direction and a high pressure priority valve for supplying a pressure oil on the highest pressure side in a plurality of pressure oils to said pressure receiving portion.

4. A pressure compensation valve unit comprising:

a check valve provided with a check valve bore to which an inlet port and an outlet port are opened and a spool inserted into said check valve bore, adapted to communicate said inlet port with said outlet port and to block the communication therebetween, pushed in the communication direction by a pressure at said inlet port and pushed in the blocking up direction by a pressure at said outlet port; and a pressure reducing valve provided with a pressure reducing valve bore to which a first port and a second port are opened, a spool inserted into said pressure reducing valve port, adapted to communicate said first port with said second port and to block the communication therebetween and having a small diameter rod opposing to said check valve, a third pressure receiving chamber receiving a pressure for pushing said spool in the blocking up direction through the communication with said second port, and first and second pressure receiving chambers formed on both end sides of a free piston slidably fitted to said small diameter rod and adapted to receive a pressure for pushing said spool in the communication direction thereof, wherein load pressures of different actuators are introduced into said first and second pressure receiving chambers.

5. A pressure compensation valve unit according to claim 4, wherein a plurality of free pistons are fitted to the small diameter rod of the spool of said pressure reducing valve, a further pressure receiving chamber for receiving a pressure for pushing said spool in the communication direction is formed between adjacent free pistons of said plurality of free pistons, and load pressures of other actuators are introduced into said other pressure receiving chambers.

6. A pressure oil supply system wherein a pressure compensation valve unit is disposed in a discharge passage of a hydraulic pump, said pressure compensation valve unit comprising:

a check valve which is pushed in an opening direction thereof by an inlet side pressure and in a closing direction thereof by an outlet side pressure and a pressure reducing valve cooperating with said check valve and actuating to establish communication between the inlet side and the outlet side of said check valve and block the communication therebetween, said pressure reducing valve having a pressure reducing valve member pushed in the blocking direction by a pressure in a pressure receiving chamber to push the check valve in the closing direction thereof, said pressure reducing valve member being pushed in the communication direction with a highest pressure in a plurality of pressures selected by a selection pressure receiving means, and communicating said outlet side with said pressure chamber;

a plurality of actuators connected to the output side of said pressure compensation valve unit through a plurality of directional control valves;

the discharge passage of said hydraulic pump connected to the inlet side of the pressure reducing valve of said pressure compensation valve unit; and load pressure of the respective actuators are introduced into said pressure selective receiving means so as to push said pressure reducing valve by the highest load pressure.

7. A pressure oil supply system according to claim 6, wherein said pressure selective receiving means is provided with a slider for pushing said pressure reducing valve in the communication direction and a pressure receiving portion receiving a pressure for pushing said pressure reducing valve in the communication direction and wherein when a pressure acting on said slider is higher than a pressure acting on said pressure receiving portion, said pressure reducing valve is pushed in the communication direction by said slider.

8. A pressure oil supply system according to claim 6, wherein said pressure selective receiving means comprises a pressure receiving portion receiving a pressure for pushing said pressure reducing valve member in the communication direction and a high pressure priority valve for supplying a pressure oil on the highest pressure side in a plurality of pressure oils to said pressure receiving portion.

9. A pressure oil supply system provided with a pressure compensation valve unit comprising:

a check valve provided with a check valve bore to which an inlet port and an outlet port are opened and a spool inserted into said check valve bore, adapted to communicate said inlet port with said outlet port and to block the communication therebetween, pushed in the communication direction by a pressure at said inlet port and pushed in the blocking up direction by a pressure at said outlet port; and a pressure reducing valve provided with a pressure reducing valve bore to which a first port and a second port are opened, a spool inserted into said pressure reducing valve port, adapted to communicate said first port with said second port and to block the communication therebetween and having a small diameter rod opposing to said check valve, a third pressure receiving chamber receiving a pressure for pushing said spool in the blocking up direction through the communication with said second port, and first and second pressure receiving chambers formed on both end sides of a free piston slidably fitted to said small diameter rod and adapted to receive a pressure for pushing said spool in the communication direction thereof; and wherein a plurality of actuators are connected to the output side of said pressure compensation valve unit through a plurality of directional control valves;

the discharge passage of said hydraulic pump is connected to the inlet side of the pressure reducing valve of said pressure compensation valve unit; and load pressures of different actuators are introduced into the first and second pressure receiving chambers of said pressure reducing valve to thereby push said pressure reducing valve in the communication direction with the highest load pressure.

10. A pressure oil supply system according to claim 9, wherein a plurality of free pistons are fitted to the small diameter rod of the spool of said pressure reducing valve, a further pressure receiving chamber for receiving a pressure for pushing said spool in the communication direction is formed between adjacent free pistons of said plurality of pistons, and load pressures of other actuators to said other pressure receiving chambers are introduced.

11. A pressure oil supply system according to any one of claims 6 to 10, wherein a load pressure detection line is connected to the outlet side of said pressure reducing valve.

12. A pressure compensation valve unit, comprising:

a check valve which is pushed in an opening direction thereof by an inlet side pressure and in a closing direction thereof by an outlet side pressure; and a pressure reducing valve, cooperating with said check valve, actuating to establish communication between the inlet side and the outlet side of the check valve and block communication therebetween, said pressure reducing valve provided with a pressure reducing valve bore to which a first port and a second port are opened, a spool inserted into said pressure reducing valve port, adapted to communicate said first port with said second port and to block the communication therebetween and having a small diameter rod opposing to said check valve, a third pressure receiving chamber receiving a pressure for pushing said spool in the blocking direction through the communication with said second port, and first and second pressure receiving chambers formed on both end sides of a free piston slidably fitted to said small diameter rod and adapted to receive a pressure for pushing said spool in the communication direction thereof; and a pressure selective receiving means for selectively receiving a highest pressure in a plurality of pressures in said first and second pressure receiving chambers to push said spool in the communication thereof.

13. A pressure compensation valve unit according to claim 12, wherein said pressure selective receiving means is provided with a slider for pushing said pressure reducing valve in the communication direction thereof and a pressure receiving portion adapted to receive a pressure for pushing the pressure reducing valve in the communication direction and wherein when a pressure acting on said slider is higher than a pressure acting on said pressure receiving portion, said pressure reducing valve is pushed by said slider in the communication direction thereof.

14. A pressure compensation valve unit according to claim 12, wherein said pressure selective receiving means comprises a pressure receiving portion receiving a pressure for pushing said pressure reducing valve in the communication direction and a high pressure priority valve for supplying a pressure oil on the highest pressure side in a plurality of pressure oils to said pressure receiving portion.

* * * * *

UNITED STATES PATENT AND TRADEMARK OFFICE

CERTIFICATE OF CORRECTION

PATENT NO. : 5,813,309
DATED : September 29, 1998
INVENTOR(S) : Keisuke TAKA and Kazunori IKEI It is certified that error appears in the above-identified patent and that said Letters Patent is hereby corrected as shown below:

On the title page,

Under Foreign Application Priority Data, should read

-- March 15, 1994 [JP] Japan 6-44150 --

Signed and Sealed this

Eighteenth Day of May, 1999

*Attest:*

*Attesting Officer*

Q. TODD DICKINSON

*Acting Commissioner of Patents and Trademarks*